US006155494A

United States Patent [19]

Fabbri et al.

[11] Patent Number: 6,155,494

[45] Date of Patent: Dec. 5, 2000

[54] ROTARY NOZZLE DEVICE FOR EMITTING A WATER JET

[75] Inventors: Fabrizio Fabbri; Filippo Cavallini, both of Modena, Italy

[73] Assignee: Annovi E Reverberi S.R.L., Modena, Italy

[21] Appl. No.: 09/191,379

[22] Filed: Nov. 13, 1998

[30] Foreign Application Priority Data

Dec. 19, 1997 [IT] Italy ..... RE97A0103

[51] Int. Cl.[7] ..... B05B 3/04

[52] U.S. Cl. ..... 239/240; 239/381

[58] Field of Search ..... 236/237, 240, 236/381

[56] References Cited

U.S. PATENT DOCUMENTS

| | | | |
|---|---|---|---|
| 3,608,828 | 9/1971 | Tokar . | |
| 3,854,664 | 12/1974 | Hunter . | |
| 4,951,877 | 8/1990 | Arsi . | |
| 4,989,786 | 2/1991 | Kranzle et al. | 239/240 |
| 5,108,635 | 4/1992 | Friedrichs | 239/240 |
| 5,332,155 | 7/1994 | Jager | 239/240 |
| 5,395,053 | 3/1995 | Frech | 239/237 |

FOREIGN PATENT DOCUMENTS

| | | |
|---|---|---|
| 0548408 | 6/1993 | European Pat. Off. . |
| 2632880 | 12/1989 | France . |
| 3419964 | 12/1985 | Germany . |
| 3708096 | 9/1988 | Germany . |
| 4328744 | 12/1994 | Germany . |

*Primary Examiner*—Kevin Weldon

*Attorney, Agent, or Firm*—Birch, Stewart, Kolasch & Birch, LLP

[57] ABSTRACT

A rotary nozzle device containing an outer casing (5) having an internal chamber (10) with a liquid exit (11) and a lateral surface of revolution upstream of the exit (11), and a rotary nozzle (20) positioned within the internal chamber (10) and traversed by an axial conduit (21) for liquid passage, and having its upper end, into which the axial conduit opens, positioned against and closing the exit (11), its final portion (24) being inclined to the nozzle axis. The nozzle (20) is positioned coaxially within the internal chamber (10) and has an outer lateral surface of revolution (20') which mates with at least one portion (12) of the lateral surface of the internal chamber, and furthermore has a lower portion (23) to which a turbine-bladed impeller is fixed, and further contains a diffuser (30) communicating with the liquid source to emit at least one jet directed to strike the turbine blades (25) so as to rotate the nozzle, and an internal channel which after the liquid has passed through the turbine blades (25) conveys it to the upstream end of the axial nozzle conduit (21).

7 Claims, 4 Drawing Sheets

ROTARY NOZZLE DEVICE FOR EMITTING A WATER JET

FIELD OF THE INVENTION

This invention relates to a rotary nozzle wash lance, ie a device for emitting a water jet the axis of which is inclined and moves about a main axis to describe a cone of revolution. The invention is used in particular for high-pressure water jets.

BACKGROUND OF THE INVENTION

To clean various surfaces (vehicles, floors etc.) it is known to use water jets at high pressure (some tens of atmospheres). For better effectiveness of the jet dynamic action, relatively small-diameter jets are used. At the same time, to increase the area struck by the jet, the spray device is made to rotate about a main axis, to which it is inclined.

SUMMARY OF THE INVENTION

An object of the invention is to provide a device with a rotary nozzle, which is effective, reliable and of relatively low cost.

This and other objects are attained by the invention as characterised in the claims.

The device according to the invention is of the type comprising an outer casing having an internal chamber with a liquid exit and a lateral surface of revolution upstream of the exit, a rotary nozzle positioned within the internal chamber and traversed by an axial conduit for liquid passage, its upper end, into which the axial conduit opens, being positioned against and closing the exit.

According to the concept on which this invention is based, said nozzle is positioned coaxially within the internal chamber and has an outer lateral surface of revolution which mates with said lateral surface of the internal chamber to form a rotoidal pair, and furthermore has a lower portion to which a turbine-bladed impeller is fixed, the final portion of the nozzle axial duct being inclined to the nozzle axis. It also comprises a diffuser means communicating with the liquid source to emit at least one jet arranged to strike the turbine blades so as to axially rotate the nozzle, and an internal channel which after the liquid has passed through the turbine blades conveys it to the upstream end of the axial conduit of the nozzle. The distance between two successive blades and their length and inclination are in such geometrical relationship with the water jet emitted by the diffuser means that this jet always strikes at least one blade, assuming the rotary nozzle to be at rest. Specifically, the axis of the water jet grazes the lower end of one blade and the upper end of the immediately adjacent blade, between two successive blades there being present a free gap arranged to allow a part of the jet water to pass when the nozzle rotates at working speed.

The invention is described in detail hereinafter with the aid of the accompanying figures which illustrate a non-exclusive embodiment thereof.

DETAILED DESCRIPTION OF THE DRAWINGS

The device of the invention comprises an approximately bell-shaped outer casing having in its upper part an internal chamber 10 containing at its top a liquid exit aperture 11.

The lateral surface of the internal chamber lying downstream of the exit is in the form of a surface of revolution. The upstream (ie lower) portion 13 of said surface has a greater diameter than the upper portion 12.

Figure 1:
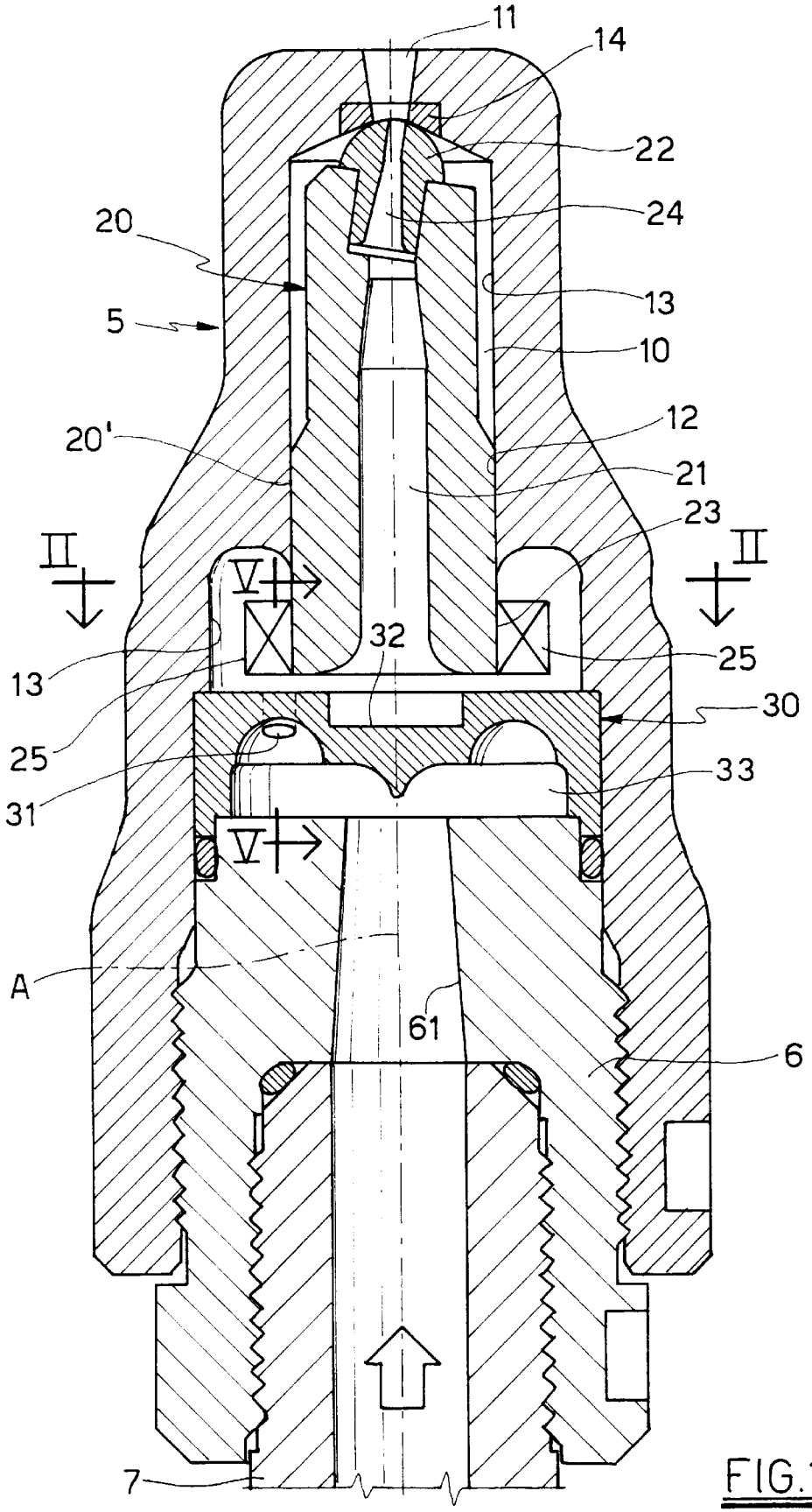
FIG. 1 is a section through the wash lance on the axial plane I—I of FIG. 1.
Figure 2:
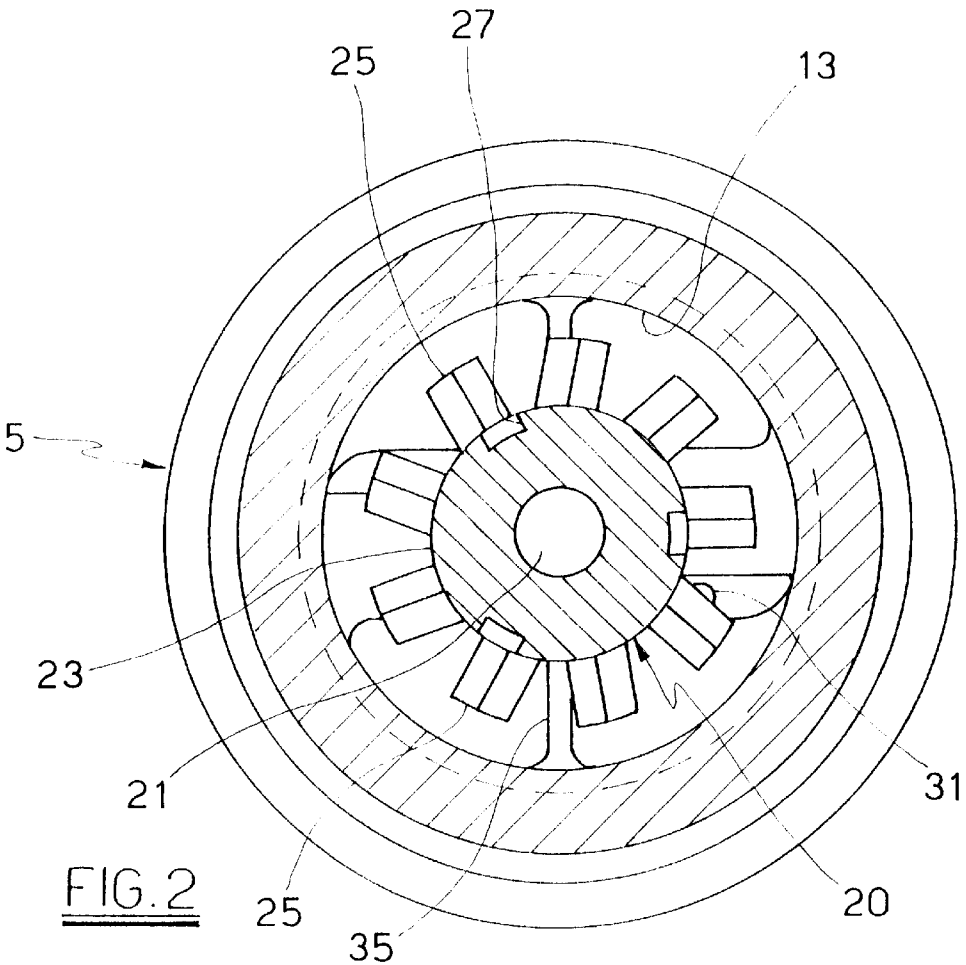
FIG. 2 is a section on the plane II—II of FIG. 1.

The casing 5 and the chamber 10 have an axis A which is vertical in FIG. 1.

The lower part of the casing 5 has a threaded inner surface defining a connector for connection to a bush 6 connected to the downstream end of a water feed pipe 7. The bush 6 has an axial conduit 61 for passage of the water originating from the pipe 7.

Within the chamber 10 there is a rotary nozzle 20 containing a water passage conduit 21 extending along the nozzle axis. The nozzle 20 has an upper portion 22 into which the axial conduit 21 opens and which lies against the aperture 11 to close it. Specifically, the upper portion 22 is defined by a separate piece joined rigidly to the upper region of the nozzle 20 and of which the top has a substantially hemispherical outer surface which rests with sliding contact against a conical seat 14 through which the aperture 11 is provided. The portion 22 closes the aperture 11 internally. A short conduit 24 defining the final portion of the axial conduit 21 is provided through the portion 22 and is inclined to the nozzle axis to be directed towards the exit 11.

The nozzle 20 is positioned coaxially within the internal chamber 10 and has an outer lateral surface of revolution 20' (for example of constant circular section, as shown in the figures) which mates with at least the upper portion 12 of the lateral surface of the internal chamber 10, so that the nozzle 20 is compelled to rotate about its axis coinciding with the axis A.

A plurality of blades 25 defining a turbine impeller are joined to the lower end portion 23 of the nozzle 20.

Below (ie upstream of) the nozzle 20 and above the bush 6 there is interposed a diffuser means 30 communicating with the conduit 61 and having at least one hole 31 arranged to emit a jet directed to strike the blades 25 in order to rotate the nozzle about the axis A.

In the embodiment illustrated in the figures there are provided two holes 31 positioned 180 degrees apart. Alternatively more holes 31 can be provided positioned angularly equidistant.

In those surfaces externally surrounding the blades 25 there is provided an internal channel which, after the liquid has passed through the blades 25, conveys it to the upstream end of the axial conduit 21 of the nozzle 20.

In the embodiment illustrated in the figures, said internal channel is defined by an annular concavity provided in the lower portion 13 of the lateral surface of the internal chamber 10, which upperly and laterally embraces the blades 25 while remaining at a suitable distance from these latter for water circulation, and is further defined by a depressed region 32 formed in the upper surface of the diffuser 30 to connect the region surrounding the blades 25 to the lower end of the conduit 21.

The blades 25 are in the form of blades projecting radially from the lateral surface of the lower portion 13, the jet emitted by the holes 31 of the diffuser means striking the surface of said blades 25 at a certain angle of inclination, such as to produce on the blades a thrust generating a torque which rotates the nozzle 20.

In operation, the water originates from the pipe 7 (source) through the conduit 61 to arrive in a central cavity 33 defined by the lower face of the diffuser 30. From here it leaves upperly through the holes 31, which are suitably sized on the basis of the physical characteristics of the water throughput normally used, such as to form relatively thin jets which strike the blades 25 with considerable kinetic energy to hence rotate the nozzle 20 about the axis A. After striking the blades 25, the water is conveyed along the surface of the lower portion 13 and the depressed region 32 to reach the conduit 21, and is finally projected to the outside by the conduit 24 via the exit 11, in the form of a jet inclined to the axis A and having the physical characteristics (velocity, diameter, etc.) required for the jet leaving the wash lance.

Given that the nozzle 20, and with it the conduit 24, rotate about the axis A, the jet produced by the conduit 24 moves over a conical surface the axis of which is A, as is required.

To achieve an effective starting thrust on the blades 25 to overcome both the initial inertia and the initial separation friction, the distance between two successive blades 25 and their length and inclination are in such geometrical relationship that the water jet emitted through the holes 31 of the diffuser means would, assuming the rotary nozzle to be at rest, always strike at least one blade 25.

Figure 6:
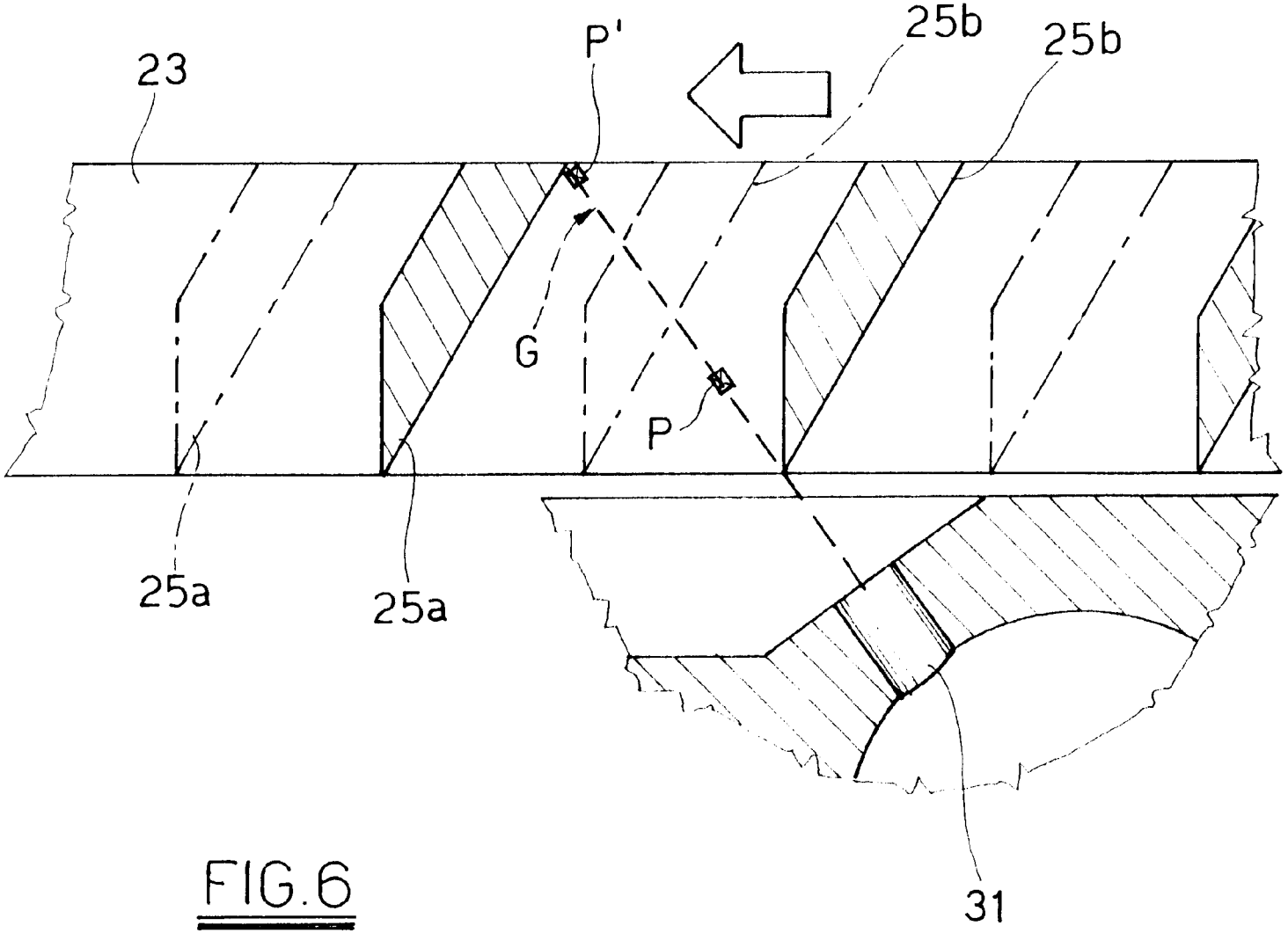
FIG. 6 is a schematic representation in plan development of the impeller blades in relation to a diffuser jet.

In particular, if the water jet axis grazes the lower end of one blade, it also grazes the upper end of the immediately adjacent blade (again assuming the rotary nozzle to be at rest). An example of this relationship is illustrated schematically in FIG. 6. The jet leaving the hole 31, illustrated schematically by an axis indicated by G, in fact touches the lower end of the rear blade 25*b* and the upper end of the front blade 25*a*.

Consequently, on starting, all the jets emitted by the holes 32 each, simultaneously with the others, strike at least one blade 25, to hence produce the maximum drive torque on the nozzle 20.

In the embodiment illustrated in the figures, the angle of inclination of the blades 25 to the axial direction is 20–45 degrees, the holes 31 being inclined to the axial direction such that the axis G of the water jet strikes the blades 25 at an angle close to a right angle.

Moreover between two successive blades there remains the widest possible free gap allowing a part of that jet water which does not strike the blades 25 to pass when the nozzle rotates at its working speed. For example, reference should be made to FIG. 6 in which the position of the blades 25*a* and 25*b* at an initial moment is indicated by full lines. Now no jet particle which at that initial moment lies in a position P, beyond the point of contact between the axis G and the rear blade 25*b*, can strike the rear blade 25*b* because the position P is already beyond that blade, neither can it strike the front blade 25*a* because when that particle reaches the top, ie at the upper end of the band of action of the blades 25 (position P'), the front blade 25*a* (illustrated by dashed and dotted lines) has already moved forwards, beyond the trajectory G.

In general, it happens that the greater the rotational speed of the nozzle 20, the greater is that proportion of the jet leaving the holes 31 which does not strike any blade 25. This phenomenon produces a stabilizing action on the nozzle speed, in the sense that this tends to rotate at substantially constant speed, in equilibrium with the opposing friction forces and dictated by the geometrical configuration of the blades 25 and of the jet leaving the holes 31. In this respect, if the speed tends to increase beyond the equilibrium speed, the unused part of the jet increases to hence reduce the drive thrust produced by the jet. In contrast, if the speed tends to decrease, the thrust produced by the jet tends to increase. Hence by suitably configuring the blade and jet characteristics, a substantially constant, stable and not excessively high speed is obtained for the nozzle 20, this being in fact desired. In this respect, too high a nozzle speed would produce at the wash lance exit a jet which is excessively dispersed and of poor effectiveness for the cleaning action for which the device is normally used.

Other usual hydraulically acting means for braking the nozzle rotation can be associated with the nozzle 20, to prevent excessive nozzle speed.

Figure 5:
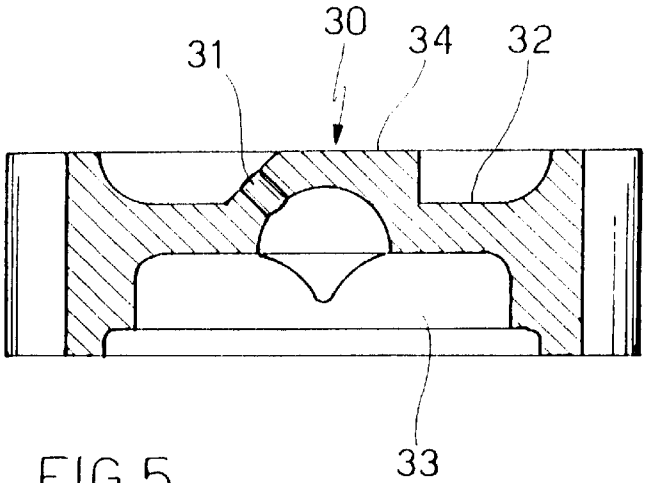
FIG. 5 is a section through the diffuser means on the plane V—V of FIG. 1.
Figure 4:
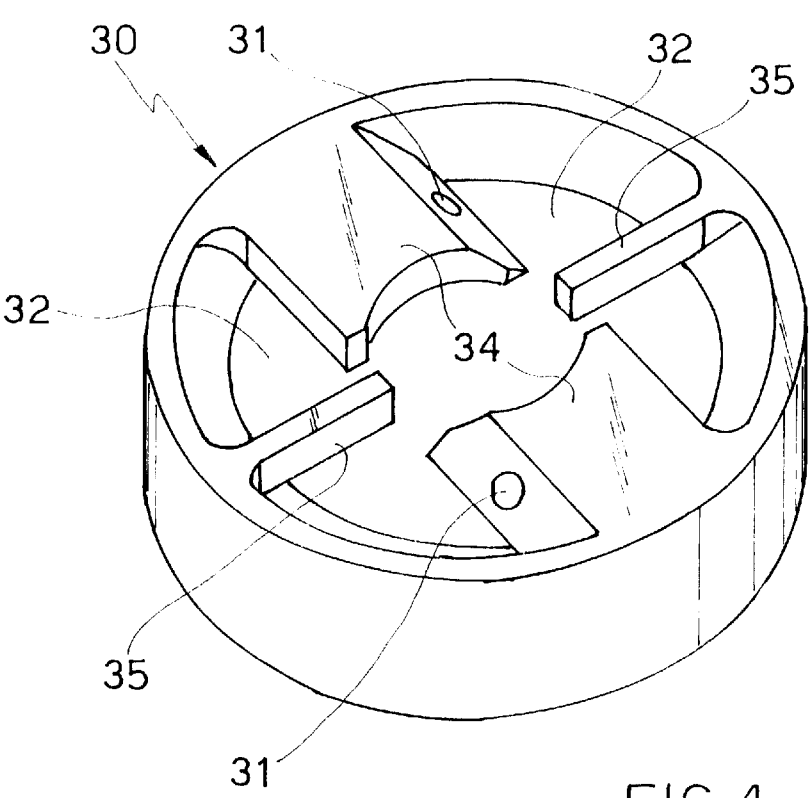
FIG. 4 is a perspective view of the upper face of the diffuser means.
Figure 3:
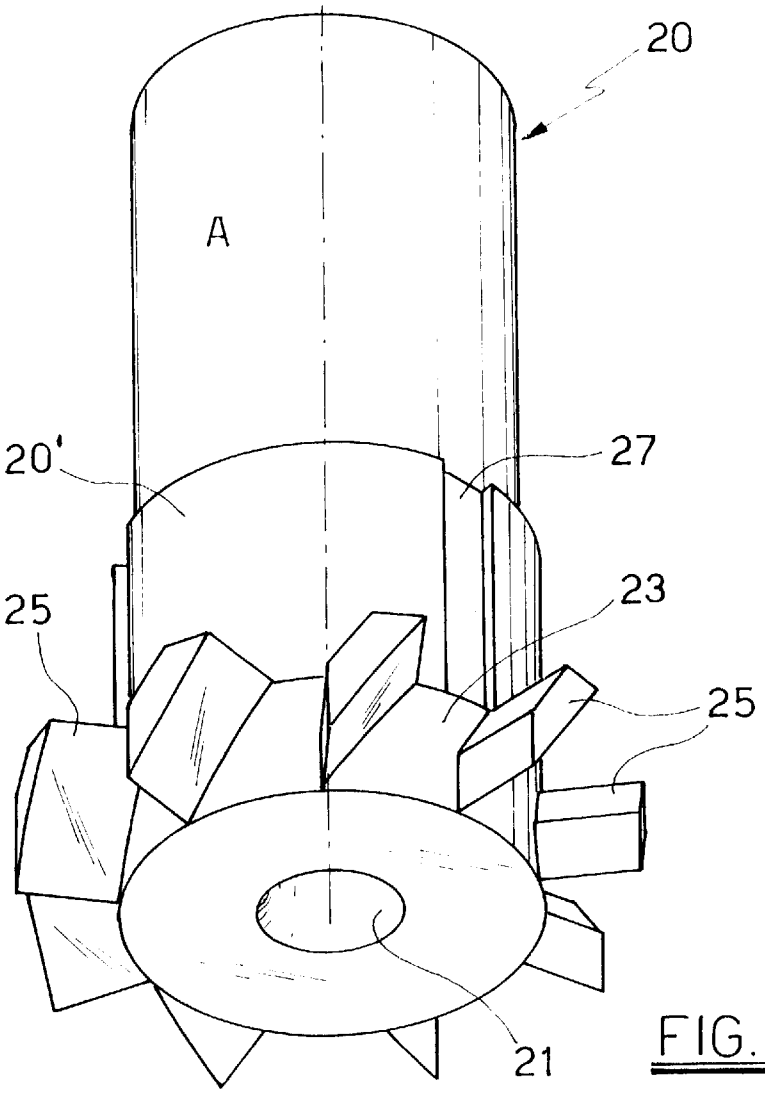
FIG. 3 is a perspective view of the rotary nozzle.

In the embodiment illustrated in the figures, the upper face of the diffuser 30 is profiled (see FIG. 4) to define two facial portions 34, 180 degrees apart, which project from the plane of depressed regions 32, the surfaces of these facial portions grazing the blades 25. A hole 31 is provided in each of the facial surfaces 34 (see FIG. 5). Two strips 35, also projecting above the plane of the depressed regions 32, are also provided in positions equidistant from said facial portions 34.

Both the facial portions 34 and the strips 35 act as guide and halting means for the flow entering the conduit 21, in order to brake the rotary movement of the water and obtain at the wash lance exit a compact jet without any damaging fraying.

Advantageously, axial grooves 27 for evacuating and containing any solid bodies transported by the water can be provided in the lateral surface 20' of the nozzle (in accordance with the embodiment shown in the figures) or in the opposing surface of the chamber 10.

Numerous modifications of a practical and applicational nature can be applied to the invention, but without leaving the scope of the inventive idea as claimed hereinafter.

What is claimed is:

1. A rotary nozzle device for emitting a water jet, comprising:

an outer casing (5) having an internal chamber (10) with a liquid exit (11) and a lateral surface of revolution upstream of the exit (11), a rotary nozzle (20) positioned within the internal chamber (10) and traversed by an axial conduit (21) for liquid passage, which extends from a lower end of the rotary nozzle and having an upper end, into which the axial conduit opens, positioned against the exit (11), wherein said rotary nozzle (20) is positioned coaxially within the internal chamber (10) and has an outer lateral surface of revolution (20') which mates with at least one portion (12) of the lateral surface of the internal chamber to thereby define a sole lateral bearing for the nozzle so that the nozzle is compelled to rotate around an axis of the nozzle, which coincides with the axis of the internal chamber, and furthermore has a lower portion (23) to which a turbine-bladed impeller is fixed, a final portion (24) of the nozzle axial conduit being inclined to the nozzle axis, and further comprises a diffuser means (30) communicating with a liquid source to emit at least one jet directed to strike the turbine blades (25) so as to rotate the nozzle, an upper surface of the diffuser means being at a distance from the lower end of the rotary nozzle to thereby define a free passage for the liquid, which after the liquid has passed through the turbine blades (25) conveys the liquid to the upper end of the nozzle axial conduit (21).

2. A rotary nozzle device as claimed in claim 1, characterised in that said turbine blades (25) are in the form of blades projecting radially from the lateral surface of the nozzle, the jet emitted by the diffuser means (30) striking the surface of said blades (25) at an angle of inclination to produce on the blades a thrust (torque) which rotates the nozzle (20).

3. A rotary nozzle device as claimed in claim 2, characterised in that the distance between two successive blades (25) and their length and inclination are in geometrical relationship with the water jet emitted by the diffuser means that this jet always strikes at least one blade (25), assuming the rotary nozzle (20) to be at rest.

4. A rotary nozzle device as claimed in claim 3, characterised in that, assuming the rotary nozzle (20) to be at rest, when the axis (G) of the water jet grazes the lower end of one blade (25), the water jet also grazes the upper end of an immediately adjacent blade (25), between two successive blades there being present a free gap arranged to allow a part of the jet water to pass when the nozzle rotates at working speed.

5. A rotary nozzle device as claimed in claim 3, characterised in that the angle of inclination of the blades (25) to the axial direction (A) is 20–45 degrees.

6. A rotary nozzle device as claimed in claim 3, characterised in that the axis (G) of the water jet strikes the blades (25) at an angle close to a right angle.

7. A rotary nozzle device as claimed in claim 1, characterised in that an internal channel is defined by an annular concavity provided in the lateral surface (13) of the internal chamber, which upperly and laterally embraces the turbine blades (25) while remaining at a distance from the turbine blades for water circulation, and is further defined by a depressed region (32) formed in the upper surface of the diffuser (30).

* * * * *